US007762246B2

(12) United States Patent
Telford

(10) Patent No.: US 7,762,246 B2
(45) Date of Patent: Jul. 27, 2010

(54) ADJUSTABLE FEED TUBE

(75) Inventor: Edward S. Telford, Loyalhanna, PA (US)

(73) Assignee: Smart Parts, Inc., Loyalhanna, PA (US)

( * ) Notice: Subject to any disclaimer, the term of this patent is extended or adjusted under 35 U.S.C. 154(b) by 1009 days.

(21) Appl. No.: 11/169,599

(22) Filed: Jun. 28, 2005

(65) Prior Publication Data

US 2006/0032488 A1 Feb. 16, 2006

(51) Int. Cl.
*F41B 11/02* (2006.01)

(52) U.S. Cl. ..... 124/49; 124/74; 285/33; 285/312; 285/420

(58) Field of Classification Search ..... 124/45, 124/49, 51.1, 73, 74; 285/33, 312, 314, 358, 285/394, 420; 24/69 R, 69 ST, 273; 403/322.4, 403/409.1

See application file for complete search history.

(56) References Cited

U.S. PATENT DOCUMENTS

| | | | | | |
|---|---|---|---|---|---|
| 249,766 | A * | 11/1881 | Hunt | 285/358 |
| 484,656 | A * | 10/1892 | Doolittle | 285/308 |
| 1,007,326 | A * | 10/1911 | Boyd | 285/336 |
| 1,110,011 | A * | 9/1914 | Schneider | 285/114 |
| 1,518,479 | A * | 12/1924 | Brewer | 285/409 |
| 2,120,184 | A * | 6/1938 | Mojonnier | 285/358 |
| 2,226,914 | A * | 12/1940 | Sharon | 285/34 |
| 4,886,304 | A * | 12/1989 | Kunsman | 285/104 |
| 5,282,454 | A * | 2/1994 | Bell et al. | 124/49 |
| 5,319,992 | A * | 6/1994 | Shui-Te | 74/543 |
| 5,380,052 | A * | 1/1995 | Hendrickson | 285/364 |
| 5,409,321 | A * | 4/1995 | Chen | 403/321 |
| 5,791,325 | A * | 8/1998 | Anderson | 124/56 |
| 5,813,258 | A * | 9/1998 | Cova et al. | 70/225 |
| 6,101,678 | A * | 8/2000 | Malloy et al. | 16/438 |
| 6,588,412 | B2 * | 7/2003 | Ferrara et al. | 124/49 |
| 6,591,824 | B2 | 7/2003 | Hatcher | 124/56 |
| 6,761,417 | B2 * | 7/2004 | Denby | 301/124.2 |
| 7,252,080 | B2 | 8/2007 | Yeh | |
| 2005/0284456 | A1 * | 12/2005 | Chipley | 124/51.1 |
| 2005/0284457 | A1 | 12/2005 | Hatcher | 124/51.1 |

OTHER PUBLICATIONS

WDP Clamping Low Rise Feed, www.pbreview.com, 3 pages.

Action Pursuit Games Magazine, Aug. 2004, LAPCO Accessories, 2 pages.

Action Pursuit Games Magazine, Apr. 1999, New View Loader Vlbows, 2 pages.

Action Pursuit Games Magazine, Dec. 1999, APP Atomic Elbow, 2 pages.

Action Pursuit Games Magazine, Mar. 2000, ACI's High Speed Elbows, 2 pages.

Action Pursuit Games Magazine, Apr. 2001, Chipley Angel Low Rise Feed Port, 2 pages.

(Continued)

*Primary Examiner*—John Ricci
(74) *Attorney, Agent, or Firm*—Simple IP Law, P.C.; Craig R. Rogers

(57) ABSTRACT

A paintball gun preferably includes an adjustable, clamping feed tube. The feed tube can, for instance, include a lever for closing and opening a clamp, thereby tightening or loosening a receiving end of a feed tube to secure or release a hopper neck. The feed tube also preferably includes a finger adjustable nut for adjusting the size of the receiving end to accommodate differently sized hopper necks.

13 Claims, 10 Drawing Sheets

OTHER PUBLICATIONS

Action Pursuit Games Magazine, Jan. 2002, Toxic Paintball, 2 pages.
Action Pursuit Games Magazine, Apr. 2002, NWPP Teardrop Highrise for Angels, 2 pages.
Action Pursuit Games Magazine, Apr. 2002, P3 Adjustable Al-Bow, 2 pages.
Action Pursuit Games Magazine, Mar. 2003, Vaporworks Spyder Xtra Vertical Feed Tube, 2 pages.
Action Pursuit Games Magazine, Apr. 2003, The Demonic Strangler, 3 pages.
Action Pursuit Games Magazine, Sep. 2003, The Grip, 2 pages.
Action Pursuit Games Magazine, Dec. 2003, Sure Fit Feeonech, 2 pages.
Action Pursui Games Magazine, May 2004, Evil Smokestack, 2 pages.
Action Pursuit Games Magazine, Jul. 2004, CP QD Feed Neck, 2 pages.

* cited by examiner

ADJUSTABLE FEED TUBE

BACKGROUND OF THE INVENTION

1. Field of the Invention

The present invention relates generally to feed tubes for connecting paintball hoppers (or loaders) to a paintball gun, and more particularly to adjustable and clamping feed tubes for paintball guns.

2. Description of Related Art

Conventional feed tubes are typically attached to a paintball gun by screwing a threaded portion of the feed tube into a receiving hole arranged near the breech end of the paint ball gun. Feed tubes provide a connection between a paintball hopper (or loader) and the paintball gun to permit paintballs from the hopper to feed into the breech of the paintball gun for launching. Hoppers typically include a storage chamber, a lid, and a neck. The neck is typically a hollow tube that fits into a receiving end of the feed tube, located opposite the threaded portion of the feed tube. The hollow portion of the hopper neck must be large enough to accommodate a paintball, which is typically about 0.68 inches in diameter. Unfortunately, however, there is no universally accepted standard for the outside diameter of the hopper neck and there is therefore variation between different hopper models.

More conventional feed tubes have included non-adjustable receiving ends, having a neck opening of a predetermined (fitted) size. Feed tubes with non-adjustable receiving ends rely on frictional engagement between the hopper and the feed tube to secure the hopper to the paintball gun. Although effective in situations where the hopper neck and feed tube opening have closely mating sizes, non-adjustable feed tubes often do not properly secure a hopper. If, for example, either the size of the hopper neck or the size of the fitted receiving end changes due to changes in temperature, the hopper may not be properly secured to the paintball gun. If the frictional engagement is not secure enough, the hopper neck may slip out of the fitted receiving end as a player moves or turns his paintball gun. Furthermore, hoppers are generally plastic, and thus the hopper flange may be easily damaged or worn out by repeated insertions and removals. Damage to the hopper neck negatively impacts its ability to properly engage with the fitted receiving end of the feed tube. And because many standards exist for hopper neck sizes, fitted receiving ends are incompatible with many hoppers.

More recently, various manufacturers have introduced feed tubes having adjustable receiving ends. Feed tubes with adjustable receiving ends generally allow a hopper flange to attach to a receiving end more securely than do fitted receiving ends. This more secure, adjustable fit solves many of the problems associated with pre-sized receiving ends, including the problems described above. However, conventional feed tubes with adjustable receiving ends often require tools to adjust a receiving end to release or secure a hopper. The use of tools requires a user to spend more time removing and securing the hopper, such as when setting up or putting away their equipment, or when clearing a jammed firing chamber. Additionally, the user needs to carry tools that may get lost during game play. The requirement for tools for securing and releasing a hopper is therefore undesirable to a paintball user both because of the time requirements and because it requires the user to carry and risk dropping and losing the appropriate tools.

Although feed tube designs have been introduced that do not require tools for adjustment, these do not typically provide as much clamping force as those that use tools. Twist-lock feed tube designs, for instance, where a user adjusts the size of the feed tube by twisting an outer portion of the feed tube, have become fairly common. The action required to tighten or release a twist-lock feed tube may also be time consuming depending on the number of turns required to adjust the tube to the appropriate size.

The paintball gun industry is in need of an adjustable feed tube that can be quickly resized to accommodate hoppers designed to different standards while providing sufficient clamping force. Users desire the ability to quickly and securely accommodate hoppers of different neck sizes without the use of tools. Various aspects and embodiments of the present invention address these and other problems associated with conventional feed tube designs.

SUMMARY OF THE INVENTION

According to one embodiment of the present invention, a clamping feed tube preferably comprises a clamping feed neck and a lever. Clamping pressure is preferably released when the lever is moved away from the feed neck and applied as the lever is moved toward the feed neck. This can be accomplished, for instance, by providing the lever with a rounded base in communication with a clamping surface. The rounded base is preferably disposed around a pivot point. The pivot point is preferably arranged through the lever to provide a narrow portion of the rounded base that gradually widens into a wider portion. The narrow portion is preferably in contact with the clamping surface when the lever is in a released (open) position, with the wider portion in contact with the clamping surface when the lever is in a clamped (closed) position. The lever is further preferably configured to remain biased in its open and closed positions until an operator applies force to the lever to move it to the opposite position. Operation of the lever preferably does not require the use of tools.

According to another embodiment of the present invention, an adjustable feed tube preferably comprises an adjustable feed neck and a finger adjustable nut. The finger adjustable nut is preferably turned to adjust the size of a receiving opening of the feed tube. This can be accomplished, for instance, by threading the nut onto a bolt arranged through openings on opposing tabs. The tabs may be arranged on opposite ends of a gap formed between opposite sides of the feed neck. Adjustment of the finger adjustable nut preferably widens or narrows the gap between the tabs and thereby adjusts the size of the receiving opening of the feed tube. Operation of the finger adjustable nut preferably does not require the use of tools.

According to still another embodiment of the present invention, a clamping feed tube preferably comprises a clamping feed neck, a finger adjustable nut, and a lever. The finger adjustable nut is preferably connected to the lever to permit adjustment of the size of a receiving opening of the feed tube. Clamping pressure is preferably released when the lever is moved away from the feed neck and applied as the lever is moved toward the feed neck. This can be accomplished for instance, by providing the clamping feed neck with a gap arranged between opposing tabs. The finger adjustable nut is preferably arranged on a threaded end of a bolt disposed through openings in the tabs. Adjustment of the finger adjustable nut preferably adjusts the size of the gap and hence the size of the receiving opening.

The lever preferably comprises a rounded end disposed around a pivot point on an end of bolt opposite the threaded end. The rounded end of the lever preferably includes a narrow portion that gradually extends into a wider portion. The narrow portion is preferably in contact with the clamping surface when the lever is in an open position, with the wider portion in contact with the clamping surface when the lever is in a closed position. The lever preferably remains biased in its open and closed positions until a user applies force to the lever to move it to the opposite position. A textured gripping surface may also be provided on the inside surface of the clamping feed neck to grip the outside of a hopper neck.

This embodiment is particularly useful because of the combination of the finger adjustable nut and lever. The lever operated clamp can be used to release clamping pressure and permit the finger adjustable nut to be readily operated while the clamp is in the open position. This makes the finger adjustable nut easy to adjust even when a user's fingers are slippery with paint. This thereby permits easy clamping and release of the feed tube without the use of tools, even with slippery hands.

BRIEF DESCRIPTION OF THE DRAWINGS

The foregoing and additional objects, features, and advantages of the present invention will become more readily apparent from the following detailed description of preferred embodiments thereof, made with reference to the accompanying figures, in which.

DETAILED DESCRIPTION

Figure 1:
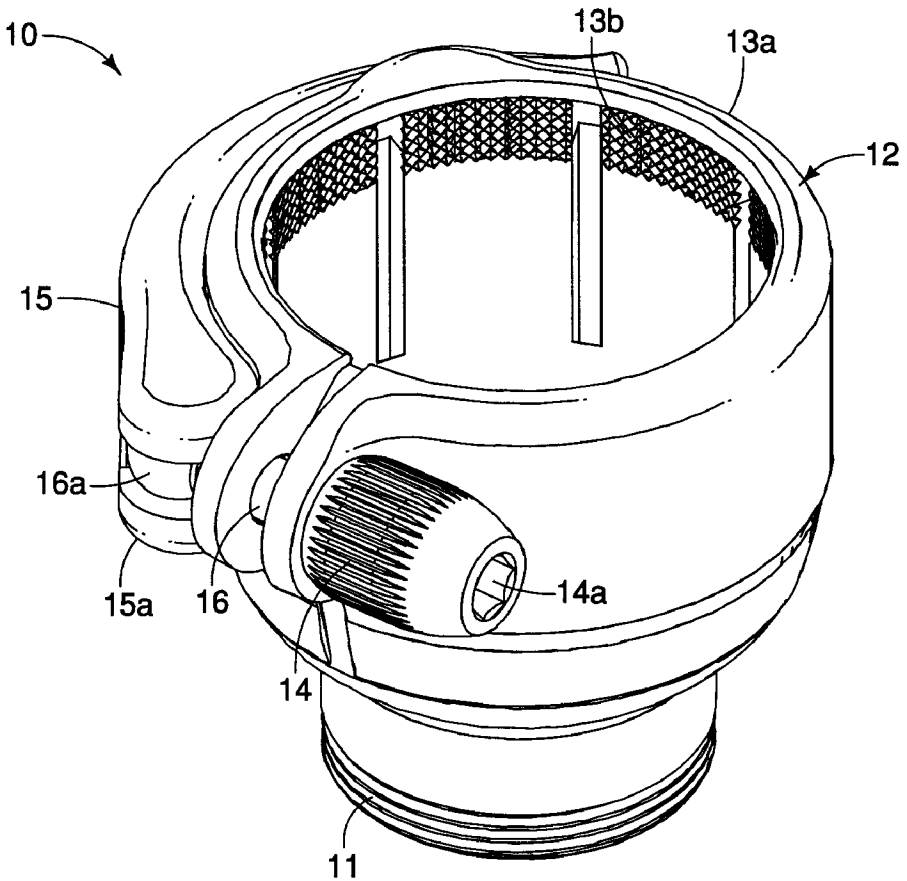
FIG. 1 is a perspective view of an adjustable, clamping feed tube according to a preferred embodiment of the present invention, shown with a clamp in a closed position.
Figure 2:
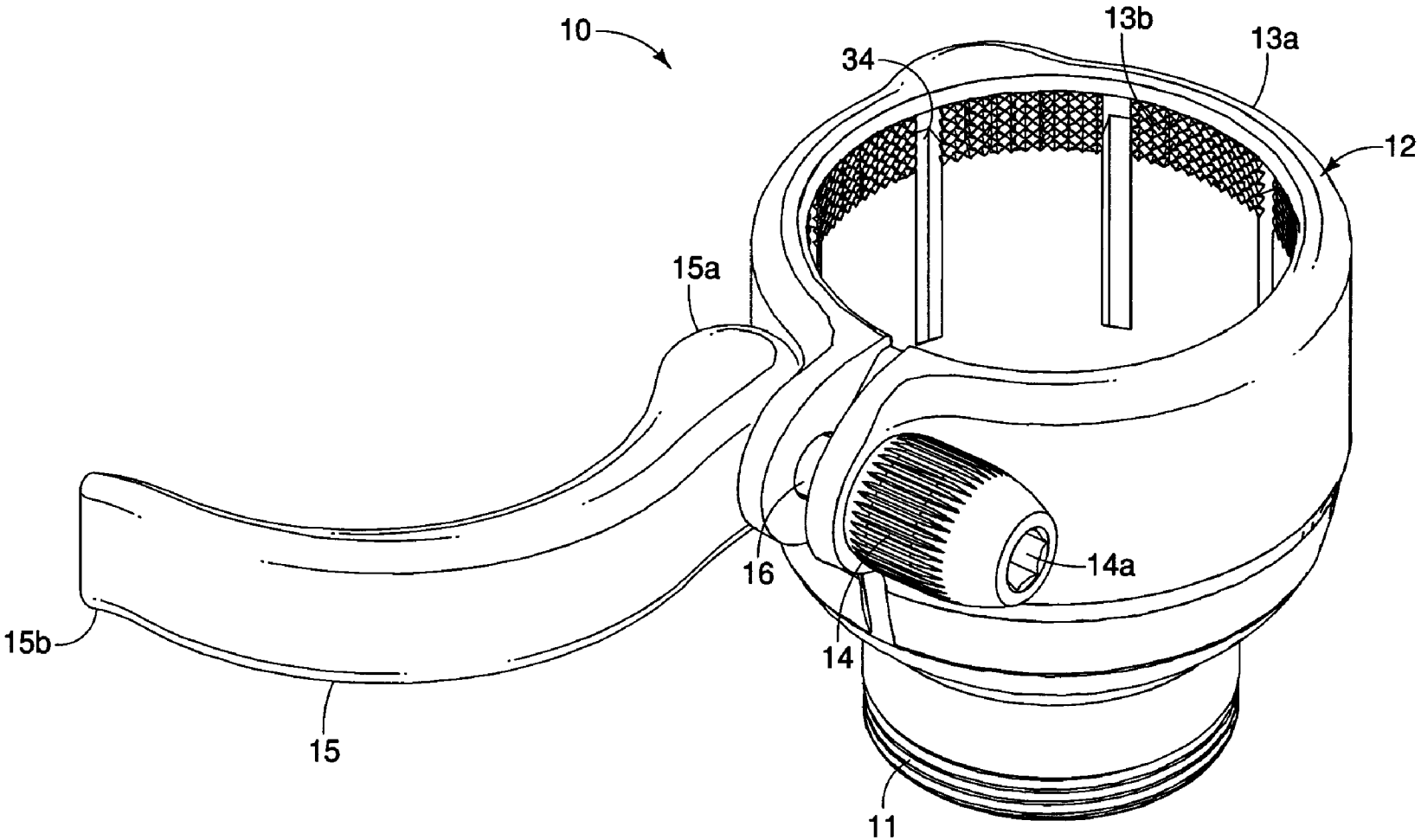
FIG. 2 is a perspective view of the adjustable, clamping feed tube of FIG. 1, shown with the clamp in an open position.
Figure 3:
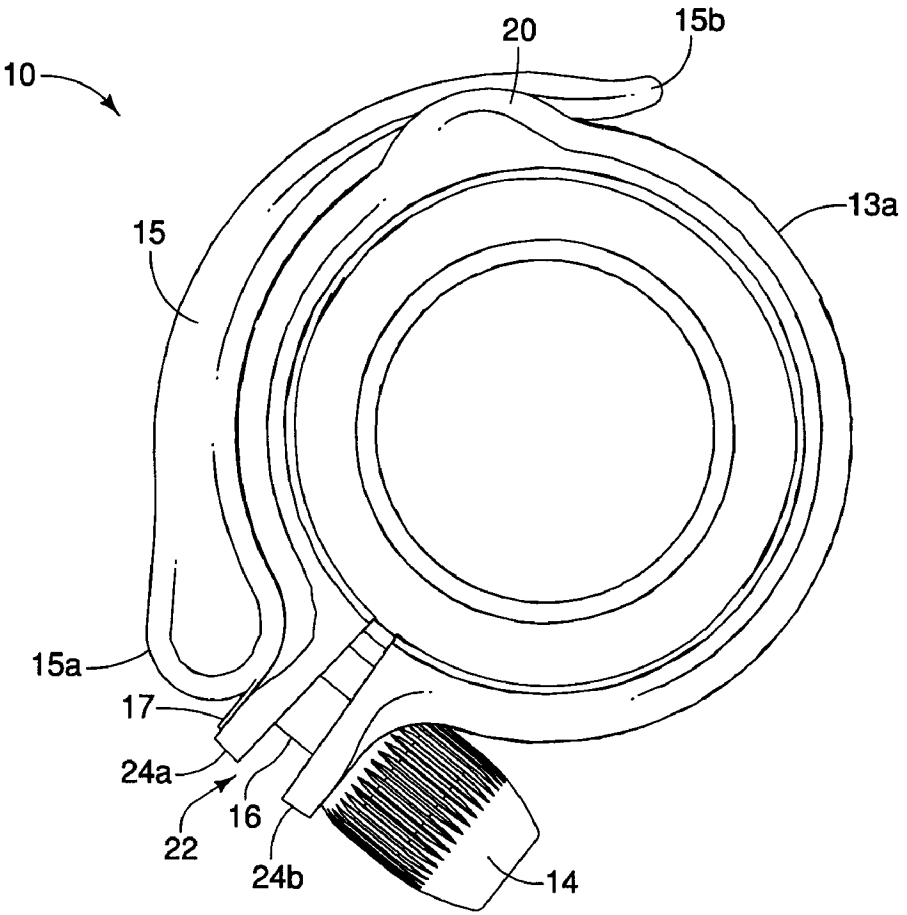
FIG. 3 is a top plan view of the adjustable, clamping feed tube of FIG. 1.
Figure 4:
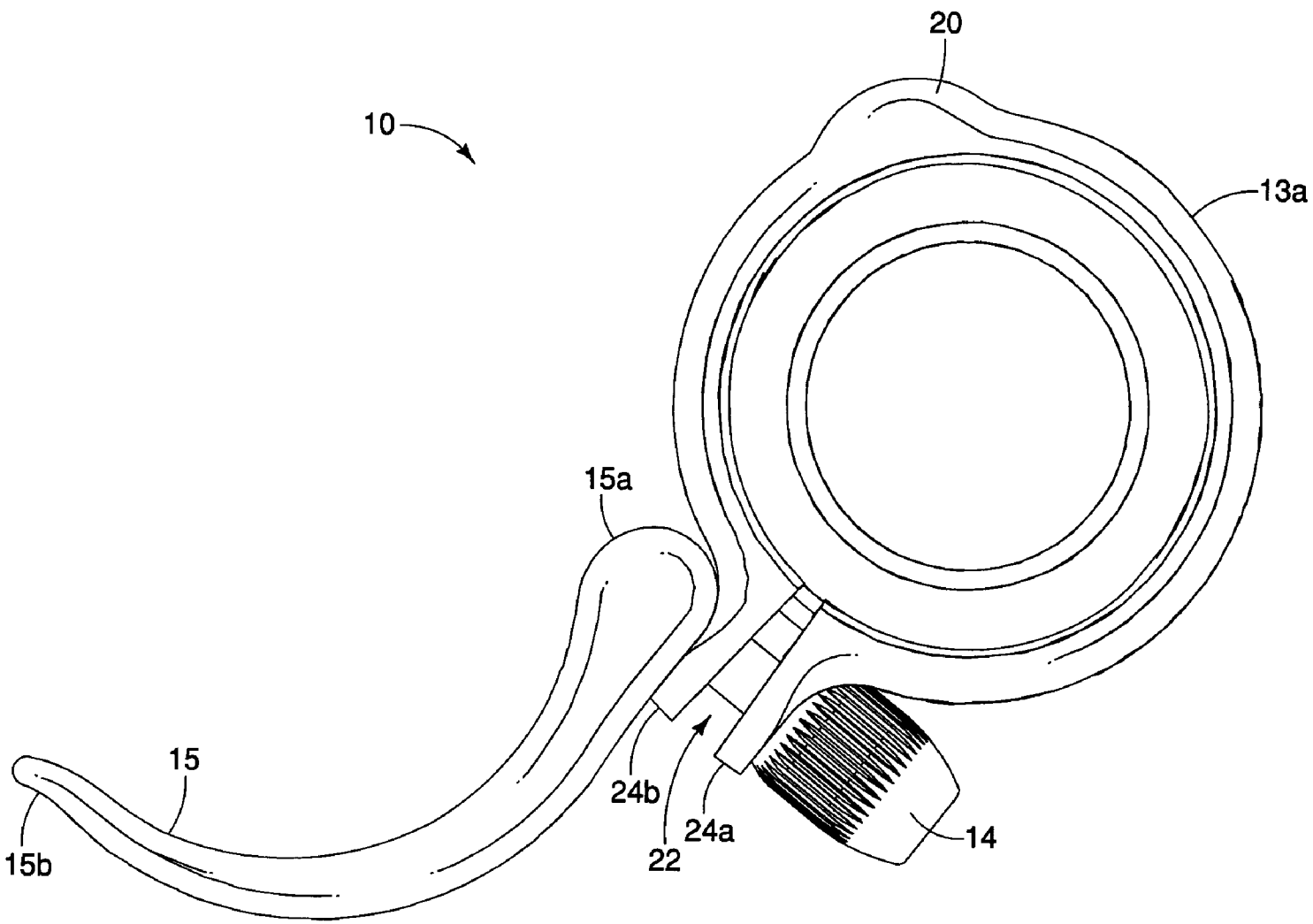
FIG. 4 is a top plan view of the adjustable, clamping feed tube of FIG. 1, shown with the clamp in an open position.
Figure 5:
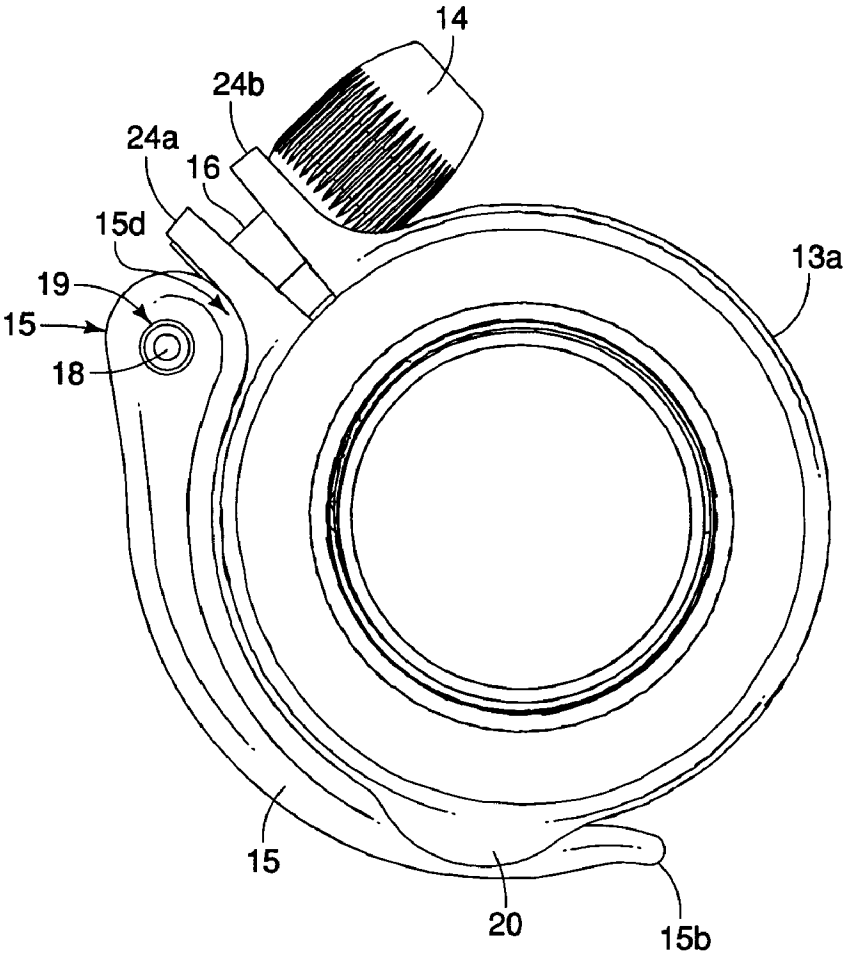
FIG. 5 is a bottom plan view of the adjustable, clamping feed tube of FIG. 1.
Figure 6:
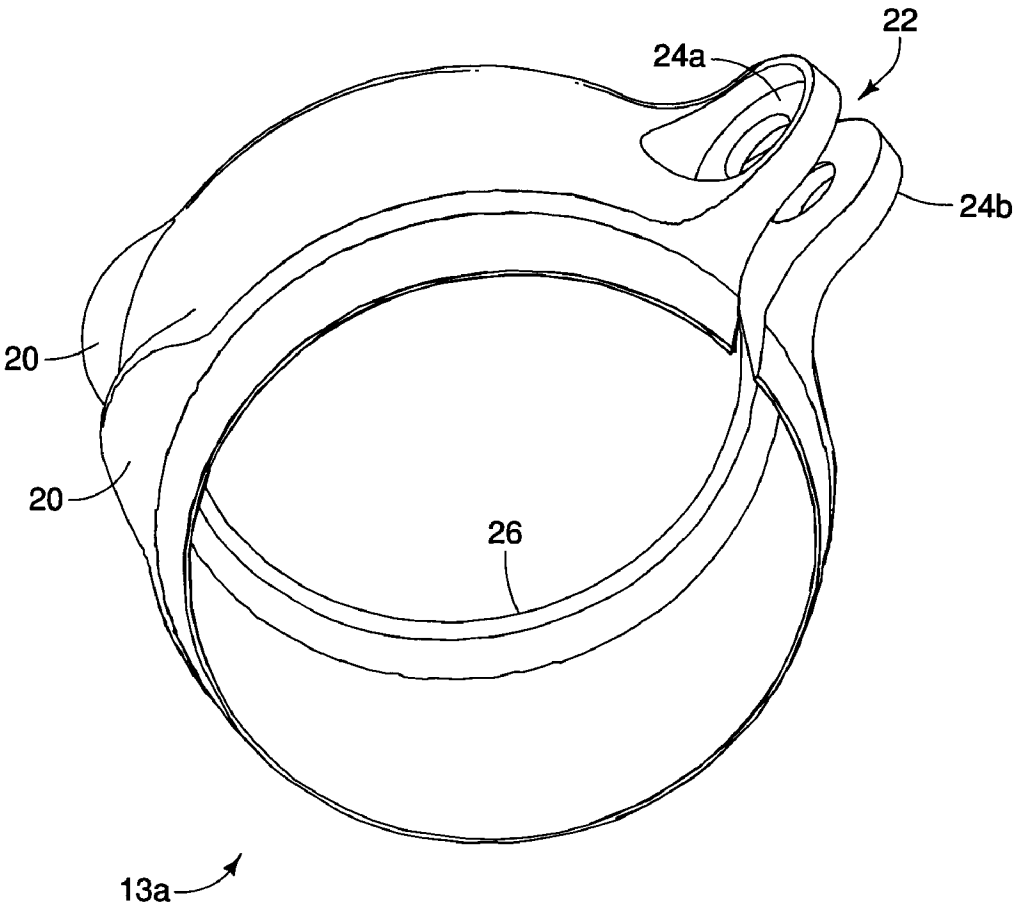
FIG. 6 is a perspective view of a clamping member of the feed tube of FIG. 1.
Figure 7:
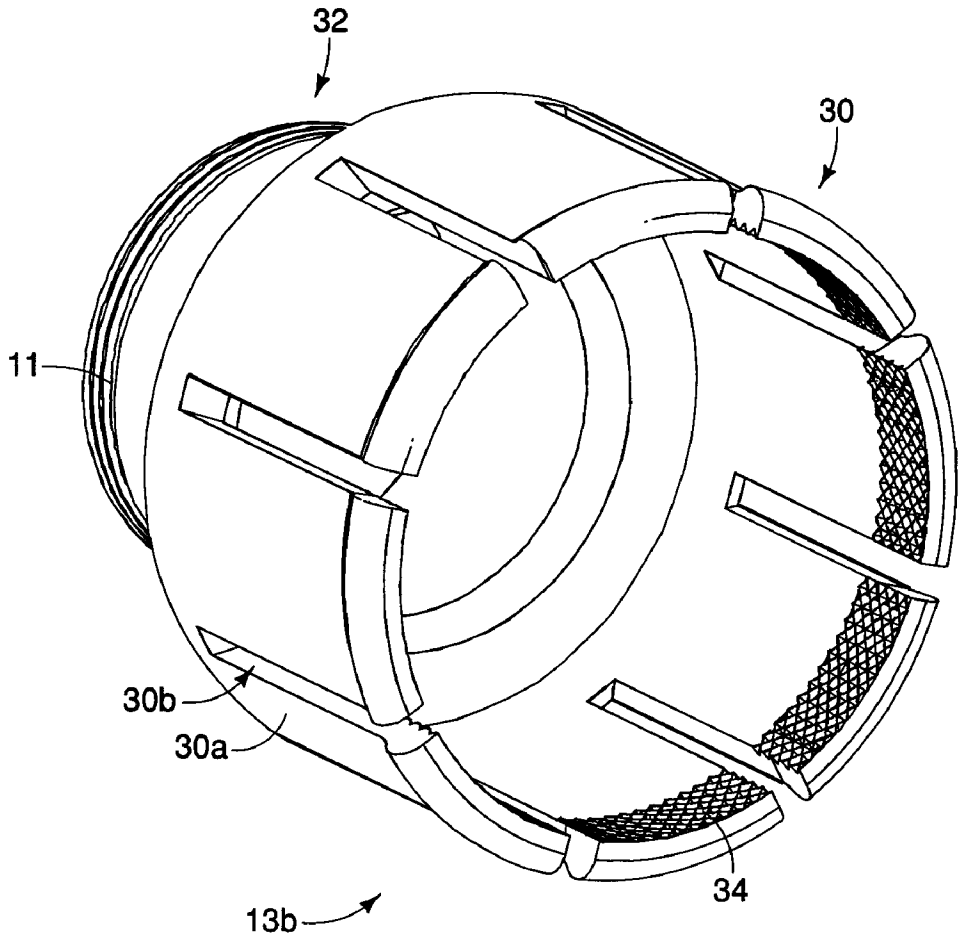
FIG. 7 is a perspective view of a feed neck of the feed tube of FIG. 1.
Figure 8:
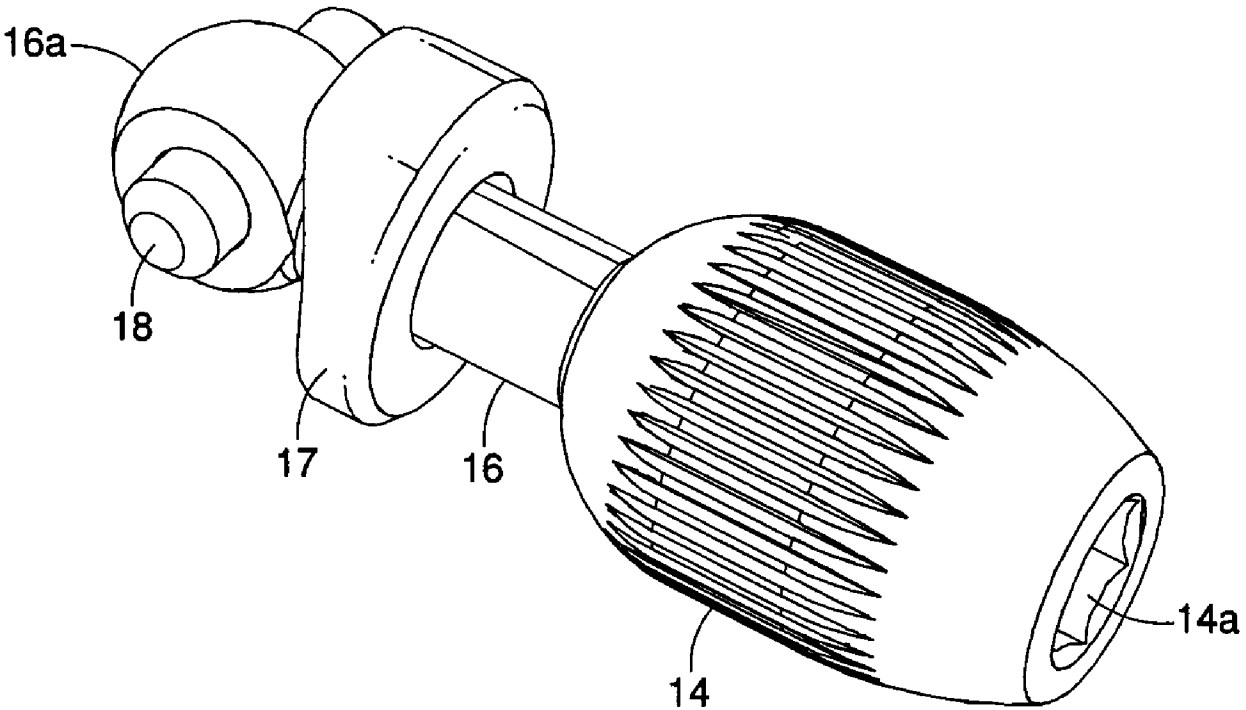
FIG. 8 is a perspective view of a bolt, nut, pin, and bushing assembly of the feed tube of FIG. 1.
Figure 9:
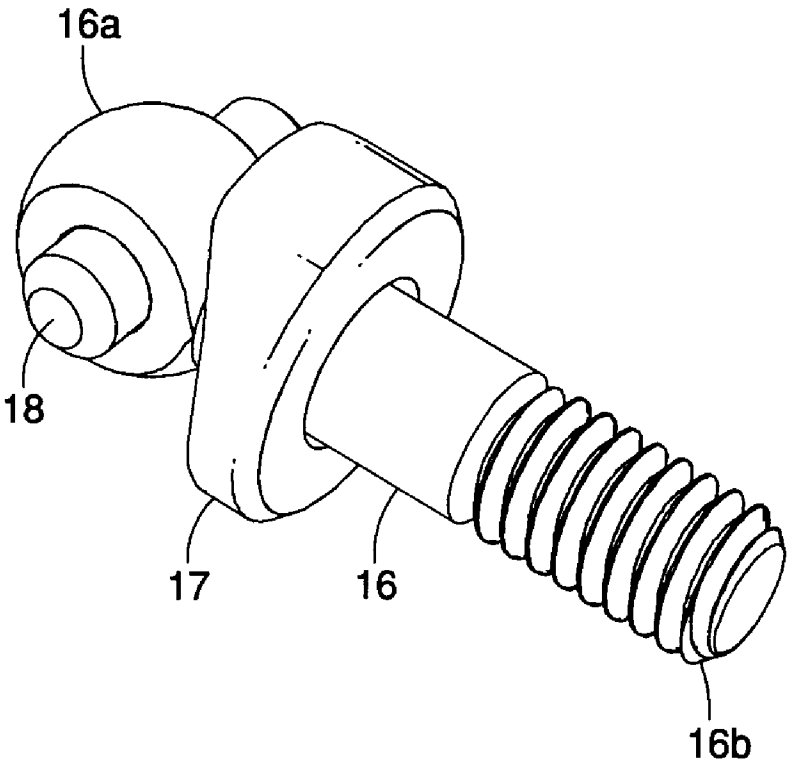
FIG. 9 is a perspective view of a bolt, bushing, and pin assembly of the feed tube of FIG. 1.
Figure 10:
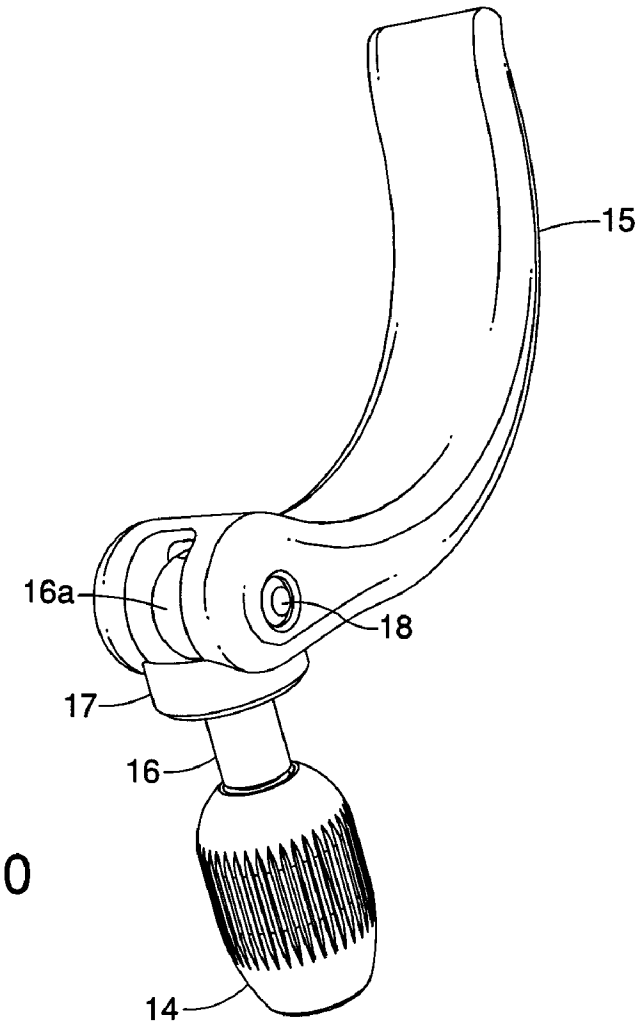
FIG. 10 is a perspective view of a bolt, nut, pin, bushing, and lever assembly of the feed tube of FIG. 1.

FIG. 1 is a perspective view of an adjustable, clamping feed tube 10 according to a preferred embodiment of the present invention, showing a clamp 13*a* in the closed position. FIG. 2 is a perspective view of the adjustable, clamping feed tube 10 of FIG. 1, showing the clamp 13*a* in an open position. FIGS. 3-5 are various views of the feed tube 10 of FIG. 1, illustrating the clamp 13*a* in both open and closed positions. FIGS. 6-10 are perspective views of various components of the adjustable, clamping feed tube 10 of FIG. 1, giving a more detailed understanding of various principles of the present invention.

Referring to FIGS. 1-10, the adjustable, clamping feed tube 10 includes a threaded portion 11 that provides a threaded engagement with a paintball gun (not shown). A receiving end 12 is located opposite the threaded portion 11 to receive a hopper neck (not shown). An opening in the receiving end 12 can be quickly enlarged by opening a clamping member 13*a*. The clamp 13*a* is preferably opened by moving the lever 15 away from the feed tube 10. A lever is preferable because it allows for a consistent clamping force and because it is easy to operate without tools, even with slippery, paint covered hands.

The clamping member 13*a* is preferably formed having, cylindrical tube-like structure with a gap 22 arranged between two opposing tabs 24*a*, 24*b*. The clamping member 13*a* further preferably includes a lip 26 arranged on an upper end. The opposing tabs 24*a*, 24*b*, preferably each include an opening for receiving a bolt 16.

The clamping member 13*a* is preferably arranged around a feed neck 13*b*. The feed neck 13*b* preferably comprises an upper receiving portion 30 for receiving a hopper and a lower attachment portion 32 for attaching to a paintball gun. The upper receiving portion 30 is preferably formed as a cylindrical tube 30*a* having a plurality of longitudinal slits 30*b* formed therein to permit flexing of the tube 30*a* and thereby also permitting resizing of the opening in the receiving portion 30. The attachment portion 32 preferably includes the threaded section 11.

The finger adjustable nut 14 is preferably arranged on a threaded end 16*b* of a bolt 16 disposed through openings in the tabs 24*a*, 24*b*. Adjustment of the finger adjustable nut 14 preferably adjusts the size of the gap 22 and hence the size of the opening in the receiving portion 30.

The lever 15 preferably comprises a rounded end 15*a* disposed around a pivot point 19 located on an end of bolt 16*a* opposite the threaded end 16*b*. A bushing 17 is preferably disposed between the rounded end 15*a* of the lever 15 and the tab 24*a*. The rounded end 15*a* of the lever 15 preferably includes a narrow portion 15*c* that gradually expands into a wider portion 15*d*. The narrow portion 15*c* is preferably in contact with the tab 24*a* when the lever 15 is in an open position, with the wider portion 15*d* in contact with the tab 24*a* when the lever 15 is in a closed position. Accordingly, as the lever 15 is moved from an open to a closed position, the rounded portion 15*a* of the lever 15 applies force against the tab 24*a*, reducing the size of the gap 22 and applying a clamping force on the feed neck 13*b* through the clamping member 13*a*.

The lever 15 preferably remains biased in its open and closed positions until a user applies force to the lever 15 to move it to the opposite position. The lever 15 is preferably curved to rest flush with the outer surface of the clamping member 13*a*. A retaining member 20 can be provided on the outer wall of the clamping member 13*a* to prevent the lever from rotating about the axis of the bolt 16 and nut 14 (i.e. threading), which in turn prevents possible increase or decrease in clamping force.

The lever 15 preferably includes a gripping end 15*b* bent outwardly from the clamping member 13*a* to permit easy gripping and operation of the lever 15. A textured gripping surface 34 may also be provided on the inside surface of the clamping feed neck 13*b* to grip the outside of a hopper neck.

After the clamp 13*a* has been opened, the size of the opening in the receiving end 12 can be further adjusted, preferably by turning the finger adjustable nut 14. Adjustment of the opening size may be useful to adapt the feed tube 10 to securely receive a hopper with a larger or smaller hopper neck. The finger adjustable nut 14 may, for instance, be tightened to secure a hopper with a smaller neck and loosened to accept a hopper with a larger neck. The finger adjustable nut 14 also preferably includes an Allen wrench socket 14*a* to permit adjustment with an Allen wrench, if desired.

In operation, the lever 15 is preferably moved outwardly from the feed tube 10 to enlarge the opening in the receiving end 12. The finger adjustable nut 14 is preferably adjusted to cause the opening in the receiving end to approximately match the outside diameter of a desired hopper neck. After (or before) the finger adjustable nut 14 has been adjusted to accommodate the hopper neck, the hopper is inserted into the opening in the receiving end 12. The clamp 13*a* is then closed via operation of the lever 15 (e.g., by pushing the lever 15 towards the feed tube 10), to secure the hopper in the feed tube 10, and hence to the paintball gun.

Various alternative embodiments of the present invention are also contemplated. For instance, one embodiment may include a lever-operated clamp without the use of a finger-adjustable nut. Yet another embodiment may comprise the use of a finger-adjustable nut without the use of a lever-operated clamp. Still other variations on the concepts disclosed herein will be apparent to those skilled in the art.

Having described and illustrated the principles of the invention in a preferred and various alternative embodiments thereof, it should be apparent that the invention can be modified in arrangement and detail without departing from such principles. All such modifications and variations come within the spirit and scope of the following claims.

What is claimed is:

1. A feed tube for a paintball gun, comprising:

a feed neck having a substantially cylindrical structure with a receiving end having an opening for receiving a paintball hopper neck and a threaded portion arranged opposite the receiving end for connecting to a paintball gun;

a plurality of slots arranged in the feed neck and extending a predetermined distance from the receiving end toward the threaded portion;

a clamp surrounding at least a portion of the receiving end for tightening the receiving end by reducing a size of the opening in the receiving end when the clamp is operated; and a lever, wherein operation of the clamp is controllable without tools by adjusting a position of the lever between an open and a closed position, and wherein the clamp further comprises a retaining member arranged on an outer surface of the clamp to assist in retaining the lever in a desired orientation with respect to the clamp.

2. The feed tube of claim 1, wherein the lever is curved to rest flush with a curved outer wall of the feed tube.

3. The feed tube of claim 1 further comprising an adjuster for adjusting a size of the opening in the receiving end that is obtained when the clamp is operated.

4. The feed tube of claim 3 wherein the adjuster can be adjusted without tools.

5. The feed tube of claim 4, wherein the adjuster comprises a finger adjustable nut having a substantially rounded, cone-like shape.

6. The feed tube of claim 1, wherein the lever comprises a rounded end configured to rotate about a pivot point.

7. The feed tube of claim 6, wherein the rounded end of the lever comprises a narrow portion and a wider portion, and further comprising a bushing arranged between the lever and the clamp.

8. The feed tube of claim 7, wherein the wider portion of the rounded end of the lever is arranged in contact with the bushing when the lever is in a closed position and wherein the narrow portion of the rounded end of the lever is arranged in proximity with the bushing when the lever is in an open position.

9. The feed tube of claim 1 further comprising a lip formed on an upper end of the clamp to at least partially cover the receiving end of the feed neck.

10. A clamping feed neck for a paintball gun, comprising:

a feed neck having a threaded connection end for connecting to a paintball gun and a receiving end, wherein the receiving end comprises an opening for receiving a neck of a paintball hopper;

a clamp for tightening the receiving end around the hopper neck when the clamp is operated, wherein said clamp comprises a substantially cylindrical body surrounding the feed neck having a gap in the body;

a plurality of slots arranged in the feed neck at the receiving end and extending a predetermined distance toward the threaded connection end;

a lever arranged to operate the clamp, wherein operation of the clamp is controllable without tools by adjusting a position of the lever; and a retaining member formed on an outside surface of the clamp to assist in retaining the lever in alignment with the clamp when the clamp is in a closed position.

11. The feed tube of claim 10, further comprising an adjuster for adjusting a size of the opening in the receiving end, wherein the adjuster can be adjusted without tools.

12. The feed tube of claim 10, further comprising a textured gripping surface arranged on an inside surface of the feed neck.

13. A clamping feeding mechanism for a paintball gun, comprising:

a feed neck comprising a substantially cylindrical body having an inside surface, an outside surface, a receiving end, and a connection end;

one or more slots formed through the feed neck body beginning at the receiving end and extending a predetermined distance toward the connection end to permit adjustment of a size of an opening formed in the receiving end;

a clamp having a substantially cylindrical body surrounding the feed neck body near the receiving end, wherein the clamp body has tabs arranged on either side of a gap formed through an entire width of the clamp body, wherein the gap permits adjustment of a size of the clamp body;

a lever mechanism comprising a lever having a rounded end, a bolt pivotably attached to the rounded end of the lever and having a threaded end, and a finger adjustable nut arranged on the threaded end of the bolt, wherein the bolt is arranged through holes formed in the tabs of the clamp body; and a lip arranged on an upper end of the clamp, a textured gripping surface arranged on the inside surface of the fee neck, and a threaded connection end for attachment to a body of a paintball gun.

* * * * *

UNITED STATES PATENT AND TRADEMARK OFFICE

CERTIFICATE OF CORRECTION

PATENT NO. : 7,762,246 B2
APPLICATION NO. : 11/169599
DATED : July 27, 2010
INVENTOR(S) : Edward S. Telford It is certified that error appears in the above-identified patent and that said Letters Patent is hereby corrected as shown below:

Cover Page: item (30) "Related U.S. Patent Documents" should read as follows: "Provisional Application No. 60/600,747, filed August 10, 2004"

Signed and Sealed this
Sixteenth Day of August, 2011

David J. Kappos

David J. Kappos
*Director of the United States Patent and Trademark Office*